US006061034A

United States Patent [19]

Agee et al.

[11] Patent Number: 6,061,034

[45] Date of Patent: May 9, 2000

[54] POWER ENHANCER FOR SOLID STATE SWITCHED ULTRAWIDEBAND PULSERS AND ARRAY TRANSMITTERS

[75] Inventors: Forrest J. Agee; Jonathan P. Hull, both of Albuquerque, N.Mex.

[73] Assignee: The United States of America, as represented by the Secretary of the Air Force, Washington, D.C.

[21] Appl. No.: 08/968,181

[22] Filed: Nov. 12, 1997

[51] Int. Cl.[7] ..... H01Q 13/00

[52] U.S. Cl. ..... 343/786; 343/876; 342/374

[58] Field of Search ..... 343/772, 774, 343/776, 785, 786, 876, 767, 853; 342/201, 368, 374, 373, 375

[56] References Cited

U.S. PATENT DOCUMENTS

| | | | |
|---|---|---|---|
| 4,905,013 | 2/1990 | Reindel | 343/786 |
| 4,993,033 | 2/1991 | Lin | 372/30 |
| 5,146,616 | 9/1992 | Tang et al. | 455/103 |
| 5,227,621 | 7/1993 | Kim et al. | 250/214.1 |
| 5,351,063 | 9/1994 | Kim et al. | 343/895 |
| 5,491,490 | 2/1996 | Kim et al. | 343/895 |
| 5,515,066 | 5/1996 | Kim et al. | 343/895 |
| 5,889,497 | 3/1999 | Brooker et al. | 343/786 |

*Primary Examiner*—Don Wong
*Assistant Examiner*—Tan Ho
*Attorney, Agent, or Firm*—William G. Auton

[57] ABSTRACT

A means is disclosed for increasing the power and field strength radiated by a solid state switched array radiator such as those used for example in ultrawideband radar systems. The incorporation of a specially designed pulsed transmission line is designed to preserve very fast rising pulses produced in each of a number of Blumleins that are triggered simultaneously or with appropriate delay to provide at the output of the stack of Blumleins a voltage that is applied to an antenna radiating element.

6 Claims, 7 Drawing Sheets

Representative Unbalanced UWB Generator Module Without Stacked Blumleins

Large Ultrawideband Solid State Switched Array

Representative Balanced UWB Generator Module
Without Stacked Blumleins

Representative Balanced UWB Generator Module
With Two Stacked Blumleins

Representative Unbalanced UWB Generator Module
Without Stacked Blumleins

Representative Unbalanced UWB Generator Module
Without Stacked Blumleins

Reflector IRA Antenna System

Timed Array IRA Antenna System

POWER ENHANCER FOR SOLID STATE SWITCHED ULTRAWIDEBAND PULSERS AND ARRAY TRANSMITTERS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to array radiators, and more particularly the invention pertains to a means for increasing the power and field strength radiated by a solid state switched array radiator such as those used in ultrawideband radar systems.

Some array radiators use a pulsed transmission line that should be designed to preserve very fast rising pulses produced in each of a number of such pulsed lines that are triggered simultaneously or with appropriate delay to provide at the output of the pulse lines a voltage that is applied to antenna radiating elements.

The pulse lines can be stacked to have the effect of multiplying the voltage that is switched by a single Blumlein by approximately the number of Blumleins in the stack. The output end of the stack of Blumleins is arranged so that the voltages add to provide approximately N-times the voltage of a single Blumlein where "N" is the number of Blumleins. The Blumleins in the stack can either be triggered simultaneously by a single switching element, or by separate switches attached to each of the Blumleins that are triggered simultaneously. The Blumleins can be triggered either simultaneously or with an appropriate delay by having separate switches attached to each of the Blumleins that are triggered by laser diodes or other light sources that are themselves triggered simultaneously or with an appropriate delay. The ability to trigger with an appropriate delay allows one to tailor the arrival time of the pulses from each of the Blumleins in the stack to compensate for differences in geometry or to apply waveform shaping to the resultant freefield burst.

A limitation on the power radiated by solid state switched array transmitters is that the voltage that can be switched by reliable solid state switches (those that have greater than $10^6$ shot lifetimes) is currently about 80 kV and generally the switch lifetime tends to diminish as the voltage is increased. In fact, the current technology in manufactured solid state switched phased array transmitters is limited to switching at about 13 kV.

Blumlein pulser technology is mentioned in U.S. Pat. No. 4,335,462, the disclosure of which is incorporated herein by reference. This patent deals with an apparatus and method for generating a globe discharge with an application for pumping lasers. U.S. Pat. No. 5,044,004 describes a flash x-ray apparatus that uses Blumleins commuted by a single thyratron switch to change the output voltage and spectrum. In neither case do these patents apply an enhanced voltage to an ultrawideband antenna, nor do they provide a means for tailoring the waveform of an ultrawideband system. Moreover, in neither case are the Blumleins independently triggered.

The present state of the art in these transmitters involves using a single switching element for each radiating antenna and therefore the voltage applied to each radiating antenna is limited to 13 kV. This in turn requires a large number of radiating elements in order to high field strengths radiated from such arrays. It also, in cases where a small source is necessary, such as in ultrawideband radars, limits the field strength that can be radiated to modest levels. The incorporation of this invention into ultrawideband transmitters would usefully increase the field strength available from compact sources and would reduce the size of the array needed to produce very high field strengths at substantial ranges.

SUMMARY OF THE INVENTION

The present invention includes an ultrawideband generator made up of a high voltage power source which produces a high voltage power signal; a power modulator which modulates the high voltage power signal from the high voltage power source to produce a modulated signal with predetermined characteristics; a switch which may be selectively triggered to conduct the modulated signal at predetermined intervals for predetermined durations, and which outputs thereby controlled bursts of the modulated signals at predetermined power and field strength level; and a set of voltage multiplying stacked Blumleins which amplify the predetermined power and field strength levels of the controlled bursts of modulated signals to output thereby amplified controlled bursts of modulated signals.

In one embodiment of the invention, the switch includes a solid state optical switch which conducts the modulated signal from the power modulator when triggered by an optical signal; and a laser trigger which emits the optical signal onto the solid state optical switch at predetermined intervals and predetermined durations desired for the bursts of the modulated signals.

In another embodiment of the invention, the set of voltage multiplying Blumleins includes: a first voltage doubling set of Blumleins which produce an output signal that increases the predetermined power and doubles the field strength of the controlled bursts of modulated signals of the switch; and additional voltage Blumleins which produce an output signal that further increases the predetermined power and further increases the field strength of the controlled bursts of the first voltage doubling Blumlein. For this embodiment, for n Blumleins or pulse lines, the radiated field strength is increased to approximately n times the field strength of a single Blumlein or pulse line.

It is an object of the present invention to provide a way of increasing the power of ultrawideband transmitters.

It is another object of the invention to minimize signal distortion and inexpensively increase the output power and field strength of radar systems and other ultrawideband systems. It is another object of the invention to provide a way of adjusting the waveform applied to the antenna of an ultrawideband transmitter.

DESCRIPTION OF THE PREFERRED EMBODIMENT

The present invention is a power enhancer apparatus for increasing power and field strength in solid state array radiators.

Figure 1:
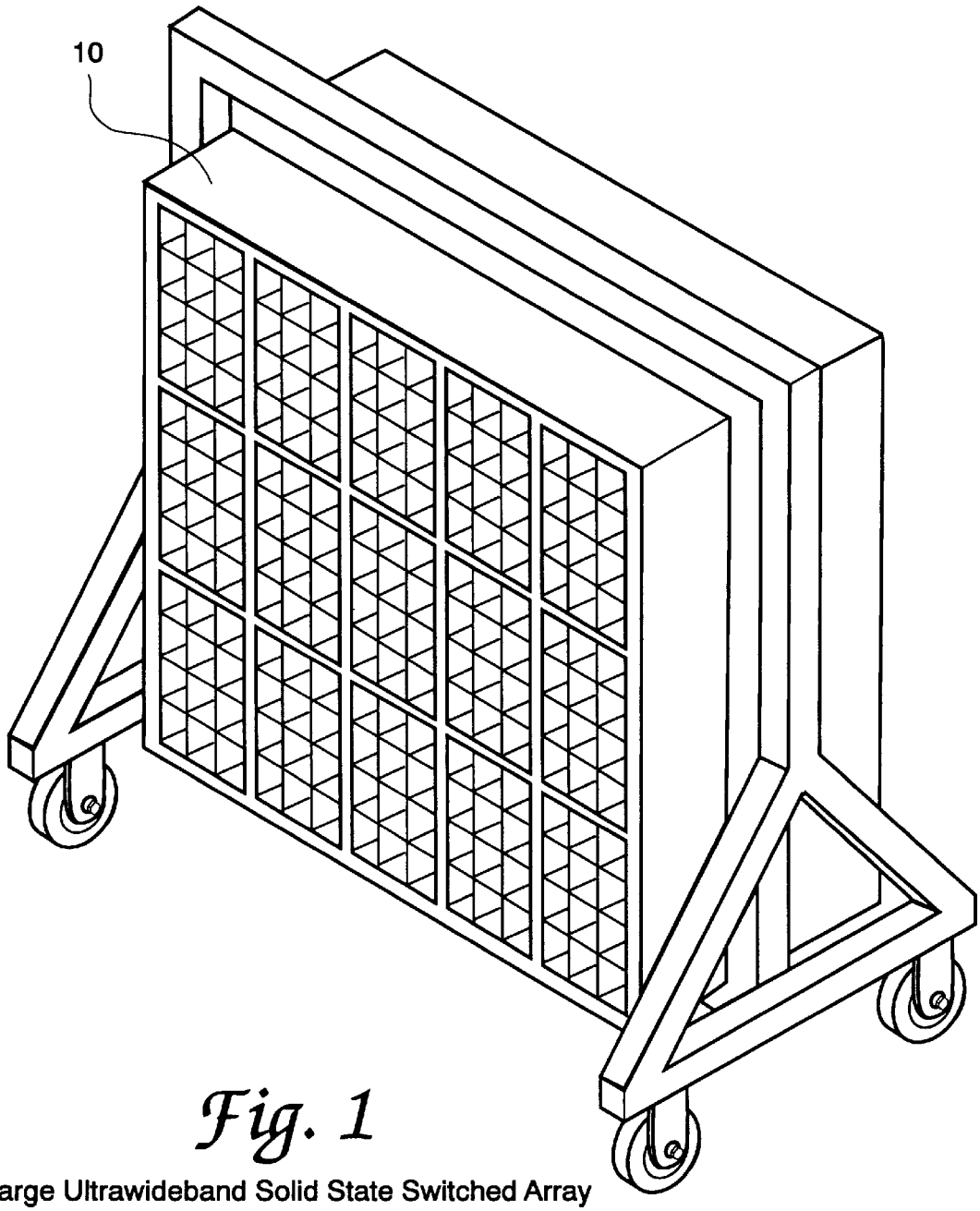
FIG. 1 is a pictorial representation of a large ultrawideband (UWB) solid state switched array.

An ultrawideband solid state switched array source having 144 switched elements 10 is shown in FIG. 1. This source is for example capable of producing very fast rising short pulses with risetimes of the order of 150 picoseconds and pulsewidths of the order of 1 nanosecond and can generate field strengths of 25 kV/m at a distance of 75 m. An advantage of this array source is that the beam can be steered by adjusting the timing of the laser trigger pulses delivered to each of the switches that supplies voltage to each radiating element. Another advantage of the flexibility of such an array antenna system is that the elements can be triggered singly or in groups to provide a series of pulses albeit at lower field strength than that when the entire array is fired in unison. A further advantage is that one can use these features to produce tailor made waveforms. This invention, when used to improve such an array radiator, not only preserves these advantages, but also allows some tailoring of the pulses that come from each radiating element when the stacked Blumleins are each triggered separately with switches and the timing of the switch firing is adjusted to change the waveform emitted from each radiating element.

A compact solid state switched source suitable for radar applications is used with the system of FIG. 1. This source has the characteristics that it is compact, and retains all of the features of control that applies to the larger array sources. This source can be a single switched radiator or an array of solid state switched radiating elements, however, the number of radiating elements is small, and its purpose is to provide a very fast rising short pulse that serves as the transmitter for an ultrawideband radar system. This source with 8 radiating elements is capable of producing pulses that have about 150 picoseconds risetime and 1 nanosecond pulsewidth and can produce a field strength at 5 meters of 30 kV/m. The application of this invention to this ultrawideband radar source can be to either increase the field strength that is radiated by the array, or to reduce the number of elements required in order to produce the same field strength. The latter advantage could be important for example for aircraft mounted radar applications where the weight of the transmitter must be kept to a minimum. Since the weight of the stacked Blumleins is small compared to the weight of a single radiating element the potential for a weight and size reduction is apparent and dramatic. For example, the use of 4 stacked Blumleins in a single element could have the effect of reducing the number of elements required for a system that normally would have 6 elements to a system that would have only 2 elements with a slight gain in performance.

Figure 2:
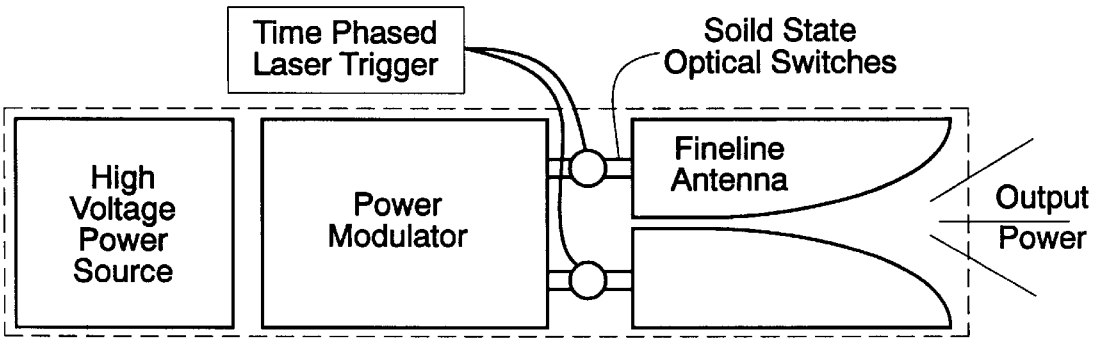
FIG. 2 is a detailed view of a representative balanced UWB generator module without stacked Blumleins.

The present art in solid state switched array ultrawideband radiators is shown in FIG. 2. A high voltage power source is used to drive a power modulator that is switched with solid state optical switches that are turned on by time-phased laser triggers that can be laser diodes. The time phasing is arranged so that a bipolar pulse is emitted. When the switches are turned on, a voltage pulse is applied to each of the 2 finlines shown in this configuration and the pulsed waveforms energize the antenna elements and an electromagnetic wave is generated by the antenna that emits the output power from the module. The modules are independently controlled, and thus, the beam from the array antenna formed by such modules can be steered or fired sequentially to produce a single large pulse or a series of pulses.

Figure 3:
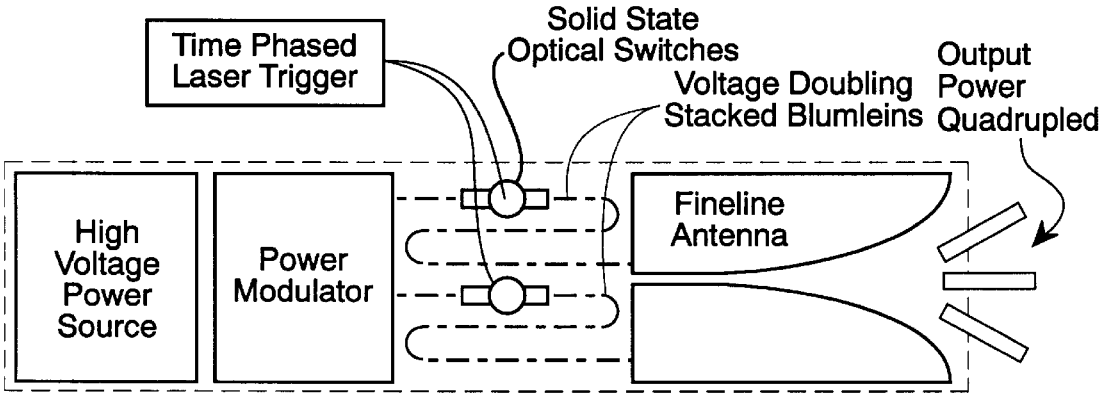
FIG. 3 gives a pictorial representation a representative balanced UWB generator module with two stacked Blumleins.
Figure 4:
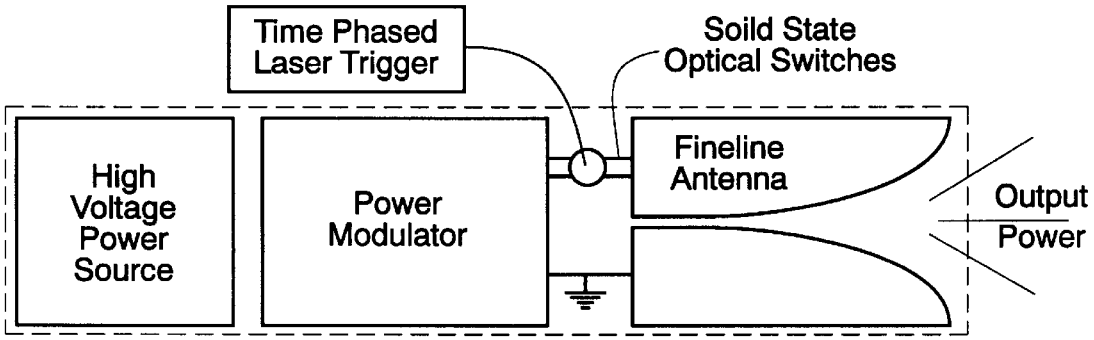
FIG. 4 is a detailed view of a representative unbalanced UWB generator module without stacked Blumleins.

One embodiment of the invention shown in FIG. 3 involves the insertion of two stacked Blumleins that drive each finline. Each pair of Blumleins is switched with a time phased laser trigger signal so that the voltage applied to the finline antenna is approximately doubled. This has the effect of doubling the field strength and increasing the output power by a factor of 4. Other embodiments of the invention would have more than 2 stacked Blumleins that are separately switched and would increase the voltage and the output power to higher values corresponding to the number of stacked Blumleins used.

Figure 5:
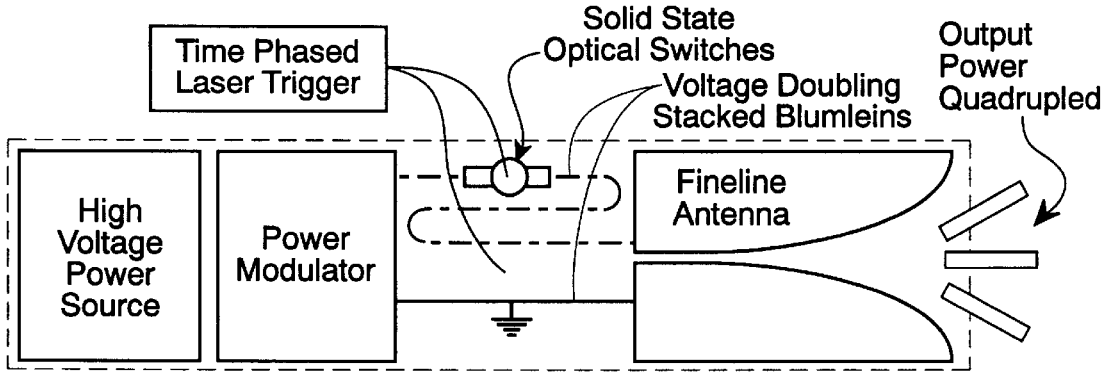
FIG. 5 is a detailed view of a representative unbalanced UWB generator module with two stacked Blumleins.
Figure 6:
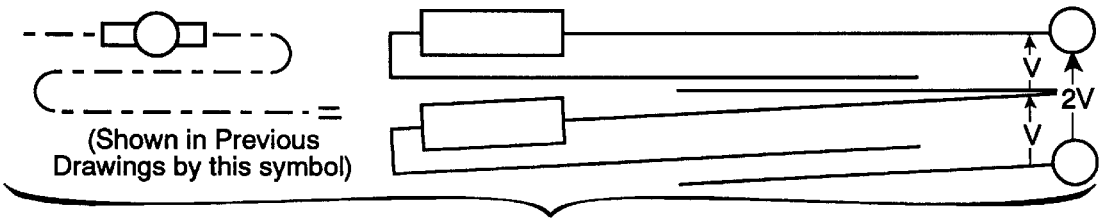
FIG. 6 is a detailed view of a stack of Blumleins with n=3

Ultrawideband generators can also be made in which one of the radiating elements is grounded and the other one is switched. This invention and the improvements that it provides can also be used to improve these sources (shown in FIGS. 5 and 6). These sources are referred to as "unbalanced" because one side is grounded. The detail of one embodiment of stacked Blumleins is shown in FIG. 5, which shows 2 stacked Blumleins. In each Blumlein the center conductor is charged relative to the lower conductor and is then switched to apply the voltage to the upper conductor and to launch a TEM wave, which then appears at the other end of the line. The stacking of the 2 Blumleins at the load end has the effect of increasing the voltage by approximately the number of lines. When this stacked voltage is properly matched to an ultrawideband radiating antenna, the voltage energizes the antenna elements and an electromagnetic wave is radiated. FIG. 6 shows an example of an unbalanced radiator with n=3, three stacked Blumleins.

Figure 7:
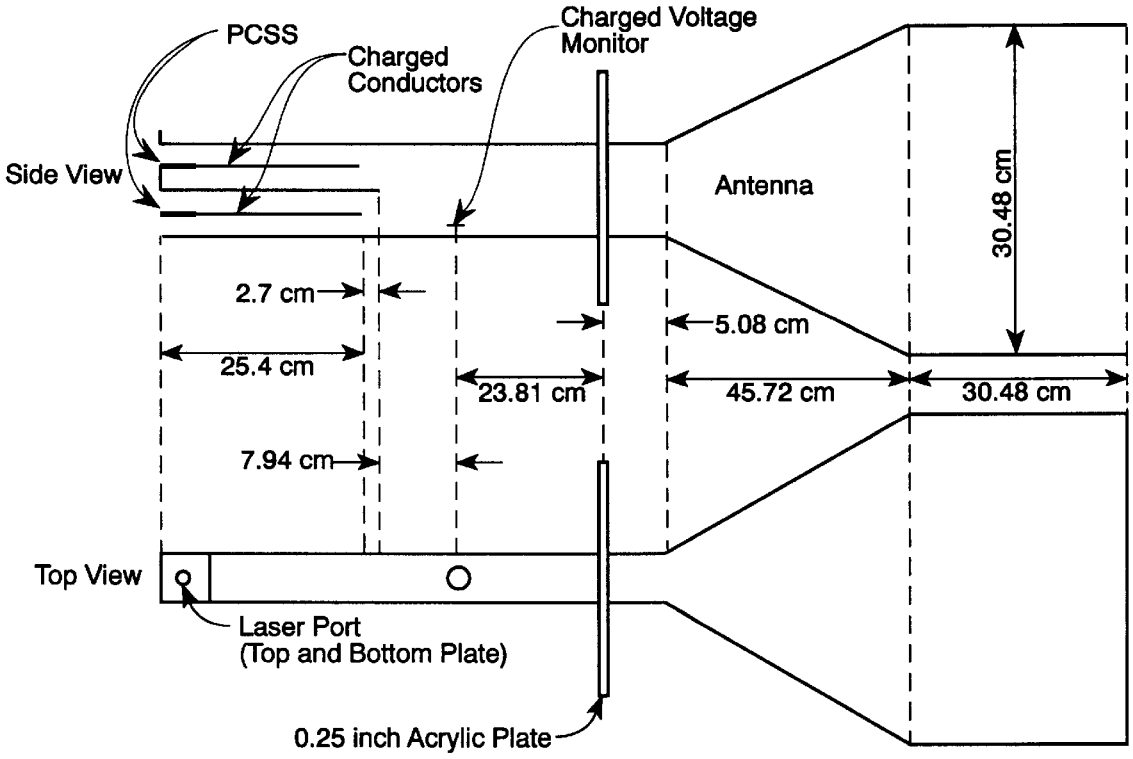
FIG. 7 is a view of an ultrawideband source and antenna with stacked Blumleins

The Blumlein/antenna experimental apparatus is shown in FIG. 7. The Blumlein structure was fabricated from 1.0 cm wide, 0.15 cm thick strips of 6061-T6 aluminum sheet metal. The top to bottom conductor spacing for each Blumlein is 0.9 cm, yielding a 90 Ohm impedance for each. The series connection allows for a matched impedance for the 180-Ohm antenna. This impedance was experimentally verified using a 20 GHz time domain reflectometer (TDR). In each Blumlein, the charged conductor is vertically centered. The top and bottom conductor of each Blumlein was resistively held to ground during the charging event. A 31.75-cm isolation line is located between the Blumlein output and the antenna input. A high-bandwidth capacitive voltage monitor was installed in the isolation line to monitor the Blumlein output voltage. The capacitive voltage monitor was calibrated with a 20 GHz TDR and a 150 ps FWHM Grant Applied Physics HYPS pulser. The monitor was verified to have a transfer function as follows:

$$V_i/V_o=50/(16\times10^3-j5.735*10^{12}/f)$$

where $V_i$ is the isolation line voltage, $V_o$ is the capacitive voltage monitor output and f is the frequency. The acrylic plate was part of the $SF_6$ containment vessel and was verified to minimally perturb the transmitted signal.

The antenna was fabricated from 0.158 cm thick 6061-T6 aluminum sheet metal. The conductor width increased linearly from 1.0 cm to 30.48 cm and the conductor separation increased linearly from 1.8 cm to 30.48 cm. The result is a broadband, TEM horn antenna of 180 ohm impedance. This impedance was experimentally verified using a 20 GHz TDR.

Figure 8:
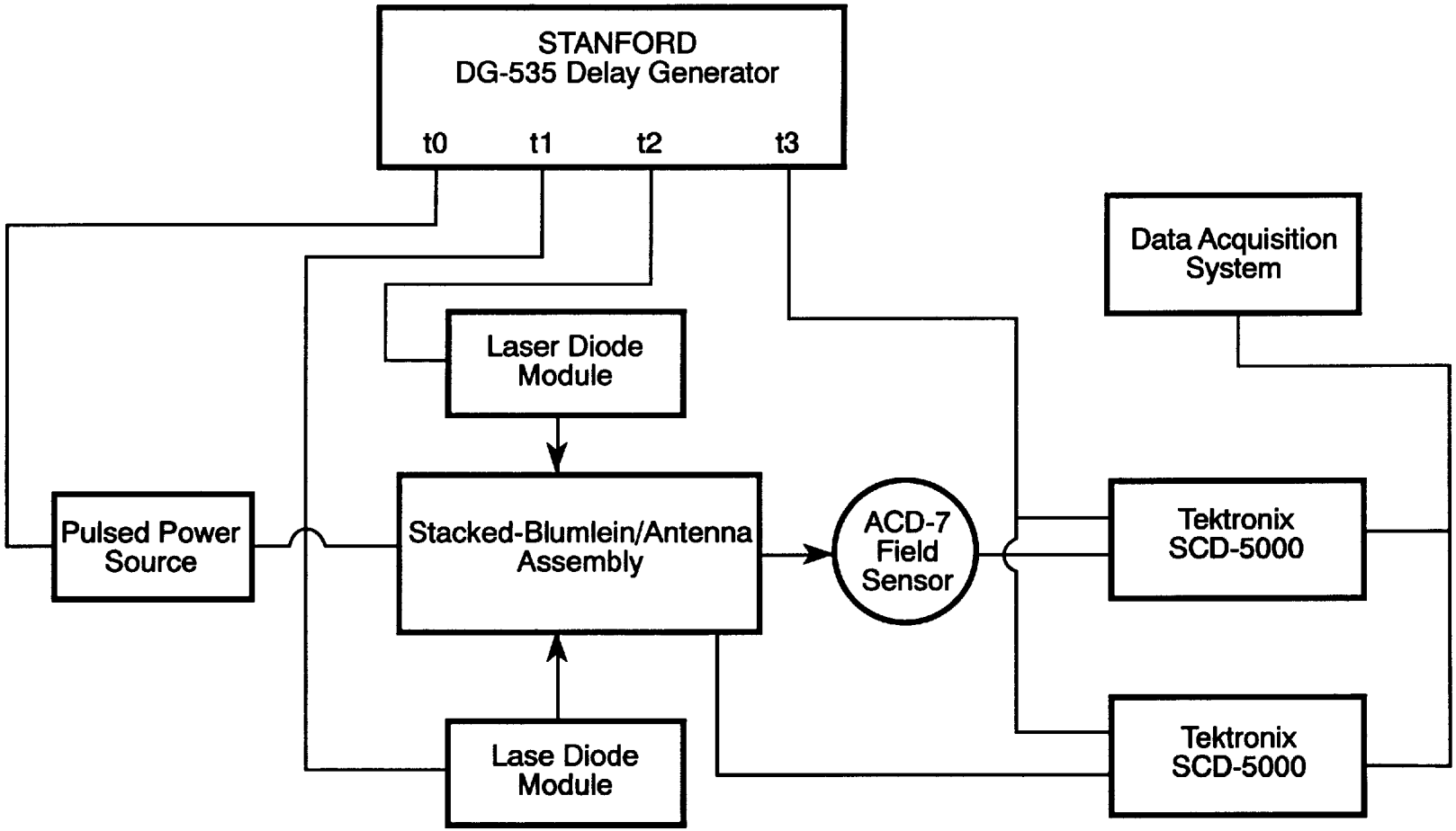
FIG. 8 is a diagram of an experimental configuration of the invention.

A block diagram of the experimental system is shown in FIG. 8. A Stanford DG535 delay generator is used to time and control the experiment. The pulsed power source is triggered which charges both of the Blumleins through isolation resistors and a peak-and-hold high voltage diode. At peak charge voltage, the pulsed power is turned off and the laser diodes are triggered which in turn illuminates and triggers the PCSS in each Blumlein. The timing of each laser diode (and PCSS) is independently adjustable to achieve maximum output pulse coherence or to tailor the waveform.

An ACD-7 D-dot sensor is located 61.0 cm from the output of the TEM horn antenna. The ACD-7 is connected to an SCD 5000 digitizer through a 3.0 GHz balun and ½ inch diameter Heliax cable. All ACD7 and capacitive voltage monitor data is stored and processed to remove sensor, balun and cable responses using a Pentium PC.

Figure 9:
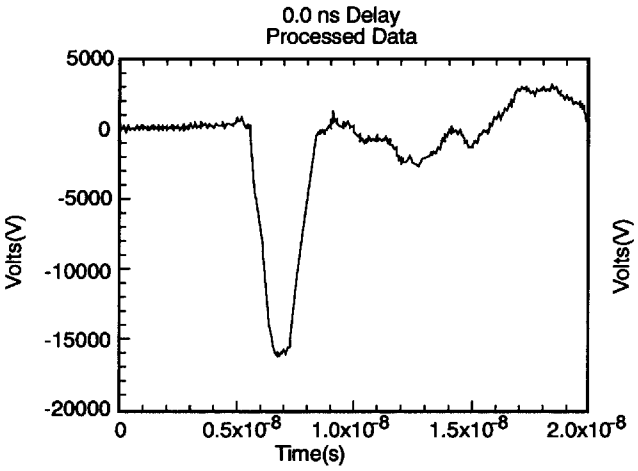
FIGS. 9–12 are charts of test data results.
Figure 10:
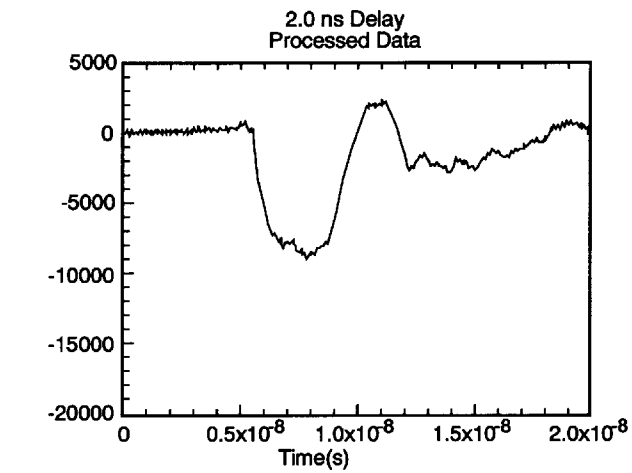
Figure 11:
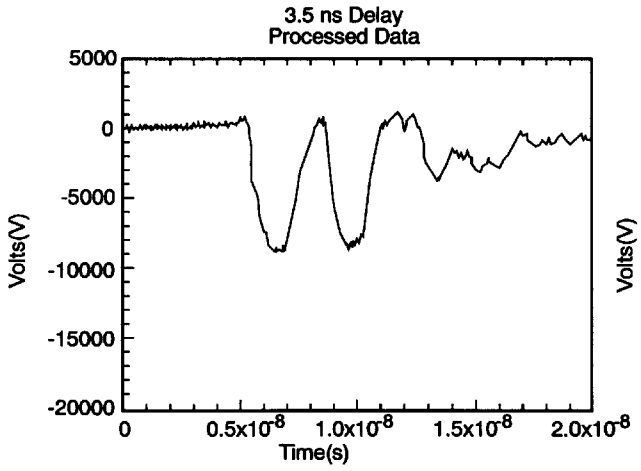
Figure 12:
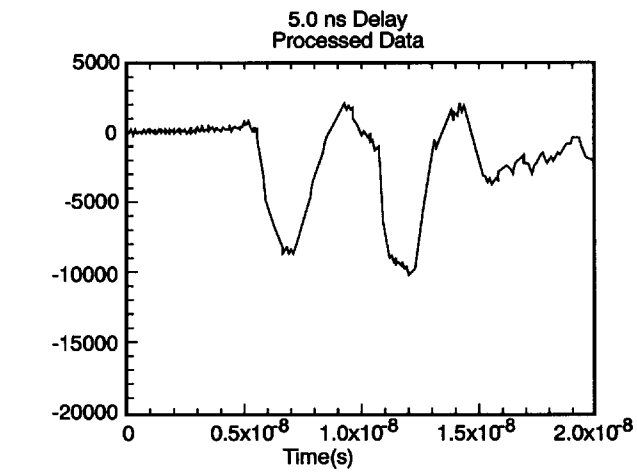

FIGS. 9–12 show the processed capacitive voltage monitor output for various laser diode timing differences at a Blumlein charge voltage of 13 kV. The ability to change the waveform by adjusting the switch timing is demonstrated here. The data in FIG. 9 shows the output when the laser diodes are timed for maximum output amplitude and minimum output width. The data show the ability to change the voltage to about twice the single Blumlein voltage by simultaneously switching the two lines.

This experiment demonstrates the feasibility of obtaining higher output voltages from two stacked Blumlein than from single Blumleins for a given charge voltage. The experiment also demonstrates the ability to construct an UWB radiating source, to increase radiated field strength and to change the power and radiated waveforms by changing the switch timing. This makes possible the rapid changing of the radiated field strength and frequency content of the pulses using electronic means associated with the triggering of laser diodes to cause the switching of the pulse lines.

Figure 13:
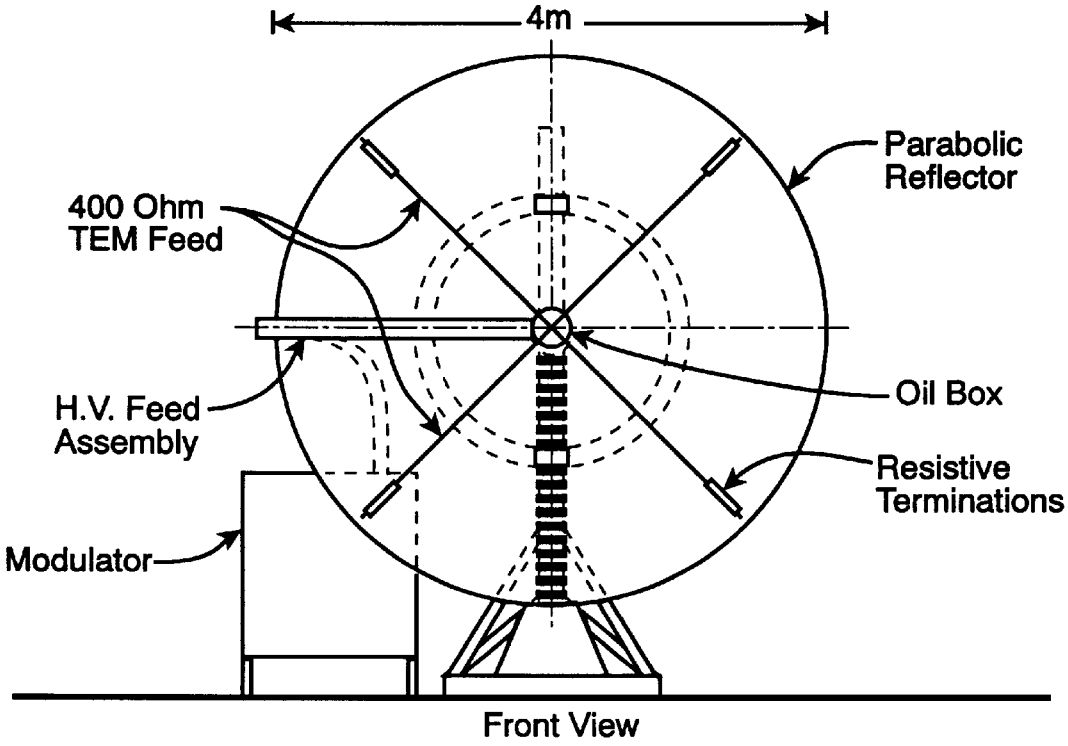
FIG. 13 is a view of a reflector IRA antenna system.
Figure 14:
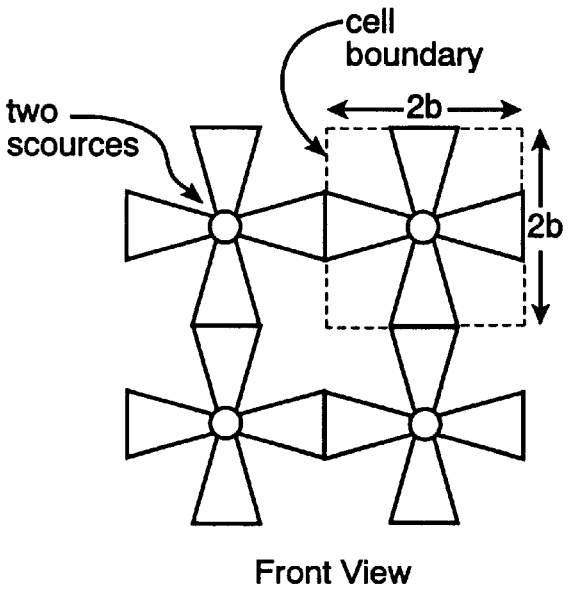
FIG. 14 is a line drawing of a timed array IRA antenna system.

The invention can be used with any ultrawideband antenna singly or in arrays of them. These antennas include reflector Impulse Radiating Antennas (IRA) (FIG. 13) and Timed Array IRA antenna systems (FIG. 14). In the latter case, when two pulsers per antenna are used, different polarizations of the emitted waveform can be launched.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. An ultrawideband generator comprising a set of n voltage doubling Blumleins that produce an output signal that is approximately n times the output of a single Blumlein that produces a predetermined power and field strength of controlled bursts of modulated signals; a high voltage power source that produces a high voltage power signal; a power modulator which modulates the high voltage power signal from the high voltage power source to produce a modulated signal with predetermined characteristics that charges the set of Blumleins; a solid state optically triggered switch which conducts the modulated signal from the power modulator when triggered by an optical signal, said switch being selectively triggered to conduct the modulated signal at predetermined intervals for predetermined durations, and which outputs thereby controlled bursts of the modulated signals at predetermined power and field strength level; and a laser trigger which emits the optical signal onto the solid state optical switch at predetermined intervals and predetermined durations desired for the bursts of the modulated signals.

2. An ultrawideband generator, as defined in claim 1, wherein the set of voltage doubling Blumlein comprises:

a set of 2 Blumleins which can be switched together to produce an output signal that doubles the predetermined power and field strength of the controlled bursts of modulated signals of the switches; and can also be fired separately with a time delay to modify the voltage waveform.

3. An ultrawideband generator as defined in claim 2, further comprising a radiating means for radiating the amplified controlled bursts of modulated signals from said sets of voltage doubling stacked Blumleins.

4. An ultrawideband generator, as defined in claim 1 wherein the set of voltage doubling Blumleins comprises:

a set of n independently switched Blumleins which can be switched together to produce an output signal that is approximately n times the output of a single Blumlein or can be switched separately with a time delay to modify the voltage waveform.

5. An ultrawideband generator as defined in claim 4, further comprising a radiating means for radiating the amplified controlled bursts of modulated signals from said sets of voltage doubling stacked Blumleins.

6. An ultrawideband generator as defined in claim 1, further comprising a radiating means for radiating the amplified controlled bursts of modulated signals from said sets of voltage multiplying stacked Blumleins.

* * * * *